US005142786A

United States Patent [19]

Hunts

[11] Patent Number: 5,142,786

[45] Date of Patent: Sep. 1, 1992

[54] VACUUM-DRAWN HAIR CLIPPER

[76] Inventor: Rick E. Hunts, 885 Barsby St., Vista, Calif. 92083

[21] Appl. No.: 780,048

[22] Filed: Oct. 21, 1991

[51] Int. Cl.[5] ..... B26B 19/44

[52] U.S. Cl. ..... 30/133; 30/201; 30/210

[58] Field of Search ..... 30/133, 200, 201, 210, 30/41.6, 233

[56] References Cited

U.S. PATENT DOCUMENTS

| | | | |
|---|---|---|---|
| 2,896,323 | 7/1959 | Guerra et al. | 30/201 |
| 3,900,949 | 8/1975 | Anzalone | 30/201 |
| 3,979,825 | 9/1976 | Baumann | 30/133 |
| 4,188,720 | 2/1980 | Korf | 30/133 |
| 4,216,581 | 8/1980 | Van Slooten | 30/133 |
| 4,628,601 | 12/1986 | Van Slooten | 30/133 |
| 4,679,322 | 7/1987 | Hunts | 30/133 |
| 4,704,794 | 11/1987 | Paradis | 30/133 |
| 4,843,717 | 7/1989 | Crane | 30/41.6 |
| 4,972,584 | 11/1990 | Baumann | 30/201 |

*Primary Examiner*—Frank T. Yost
*Assistant Examiner*—Hwei-Siu Payer
*Attorney, Agent, or Firm*—Henri J. A. Charmasson

[57] ABSTRACT

A precision hair clipper for cutting the hair of a subject to a uniform length comprises a housing defining a flow chamber attachable to a vacuum source. At the inlet of the housing a pair of reciprocating blades occupy one side of a quadrangular rim. The blades have rows of cooperating teeth facing the opening of the inlet. A bar commensurate with and parallel to the blade teeth is reciprocally translated across the opening between the teeth and the opposite edge of the rim. Hair drawn through the flow chamber is thus periodically pushed against the shearing teeth. The bar movement is coupled to the blade oscillating mechanism.

7 Claims, 3 Drawing Sheets

VACUUM-DRAWN HAIR CLIPPER

FIELD OF THE INVENTION

This invention relates to hair cutting tools and more particularly to motor-driven clippers which are connected to suction devices such as vacuum cleaners, wherein the airflow is used to pull the hair to a convenient cutting position and to efficiently evacuate the clippings.

BACKGROUND OF THE INVENTION

Various devices of this type have been proposed in the past. In a first group best exemplified by U.S. Pat. Nos. 1,238,461 Bourdelat, 2,980,994 Stachon, and 3,138,870 Stachon, a rotating blade is mounted across the vacuum flow channel. A second group of such clippers as disclosed in U.S. Pat. Nos. 1,730,889 Hoberecht, 3,979,825 Baumann, 4,077,122 Rollor, Jr. et al., and 4,188,720 Korf uses oscillating blades, the latter with the added improvement of translating movement of the oscillating blade across the hair flow channel. The avowed object of such an improvement was to cause a straight alignment of the hair under the vacuum pull and an even cutting to a constant length. The Korf approach requires a complex mechanism and suffers from the fact that large quantities of hair drawn into the vacuum channel, when attacked by the advancing blade may bunch up and bend away from the blade. This may result in a very uneven clipping of some of the hair. The translating movement of the blade carriage takes time and consumes a great deal of energy.

In some of the earlier devices the rotary blades interfered with the regular flow of hair through the housing, causing pulsation and turbulence which prevented the proper alignment of the hair.

An improved clipper is disclosed in my U.S. Pat. No. 4,679,322 wherein the oscillating blades are not translated and are configured to avoid interruption of the hair flow.

SUMMARY OF THE INVENTION

The principal and secondary objects of the present invention is to offer an alternate vacuum-drawn, hair clipping mechanism where the shearing blades are not translated, and the flow of hair is never completely interrupted. This mechanism is characterized by the use of a feeding bar which is translated across the flow chamber inlet parallelly to the shearing teeth of the blades. The bar periodically pushes the hair drawn through the flow chamber against the blades. A length adjustable bellowed extension is mounted against the precisely position the blade at a chosen distance from the subject's scalp.

DESCRIPTION OF THE PREFERRED EMBODIMENT

Figure 1:
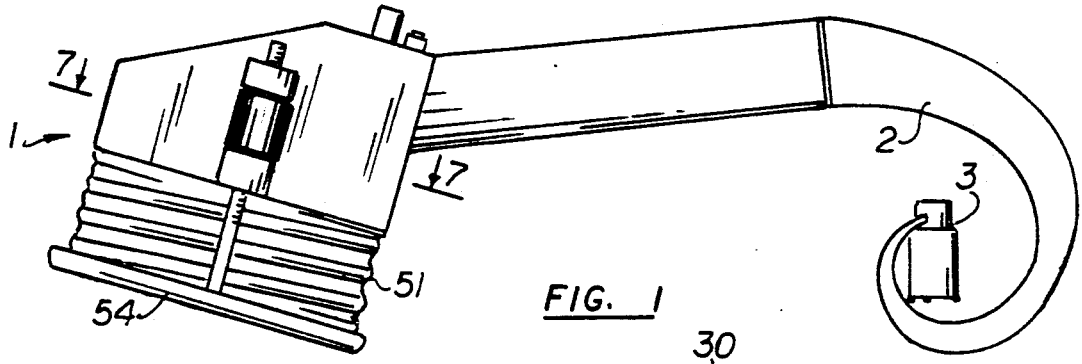
FIG. 1 is a side view of the hair clipper according to the invention.
Figure 8:
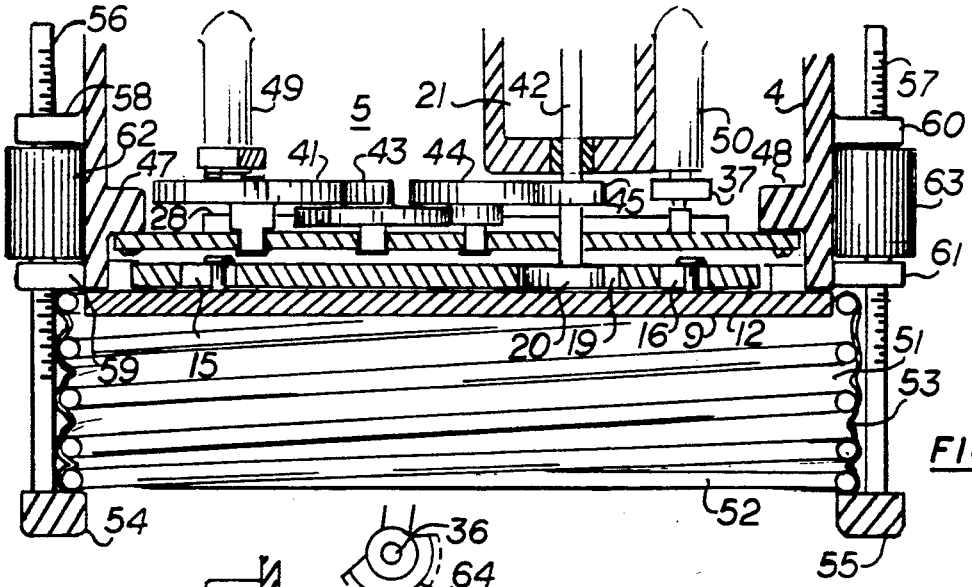
FIG. 8 is a cross-sectional view taken along line 8—8 of FIG. 3.
Figure 2:
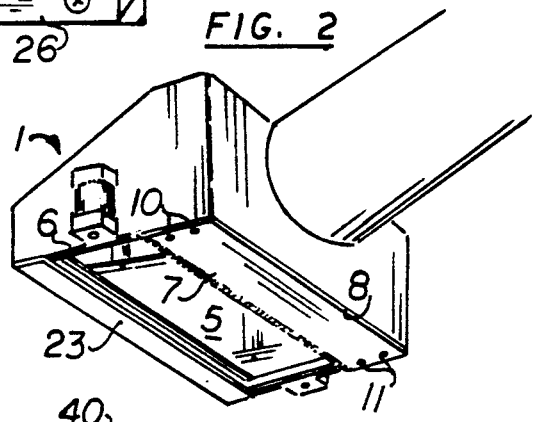
FIG. 2 is a bottom, back and side perspective view thereof.
Figure 5:
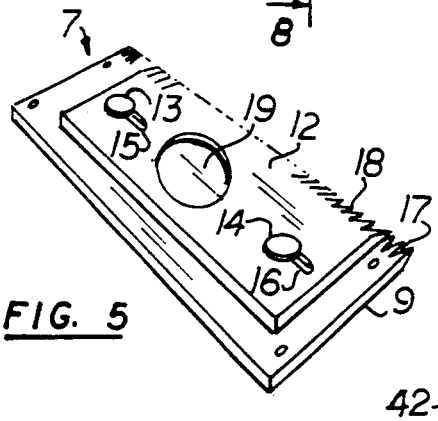
FIG. 5 is a perspective view to the blade assembly.
Figure 4:
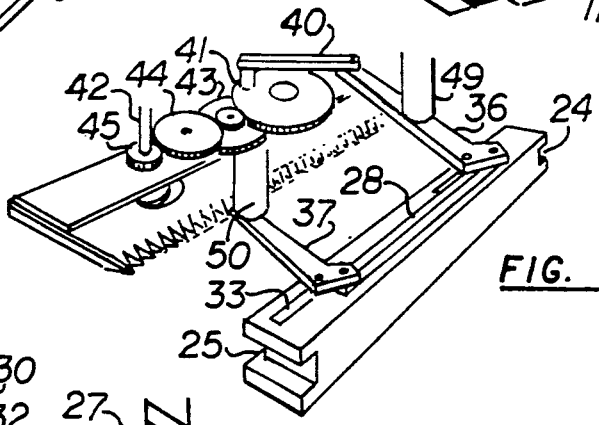
FIG. 4 is a perspective illustration of the bar driving mechanism.

Referring now to the drawing, there is shown in FIG. 1, a hair clipper 1 connected by a flexible hose 2 to a vacuum cleaner 3. As shown in FIG. 2, the hair clipper mechanism is contained in a housing 4 defining a flow chamber 5 with a bottom inlet having quadrangular rim 6. A blade assembly 7 more specifically illustrated in FIG. 5, is mounted along a transversal edge 8 of the rim. A lower blade 9 is fixedly attached to the rim by two pairs of screws 10, 11. An upper blade 12 is slidingly mounted on top of the lower blade 9 and retained thereon by two rivets 13, 14 extending from the lower blade in passing through longitudinal slots 15, 16 of the upper blade. The upper blade 12 can be transversally oscillated. The lower blade has a row of shearing teeth 17 which cooperates with a corresponding row of shearing teeth 18 of the upper blade 12 positioned above and in line with the first row of teeth 17. A circular opening 19 in a central section of the upper blade is engaged by an eccentric cam 20 driven by an electrical motor 21 located in the central upper part of the flow chamber 5 as best shown in FIG. 8. The motor is controlled by a switch 22 in the roof of the housing.

Figure 7:
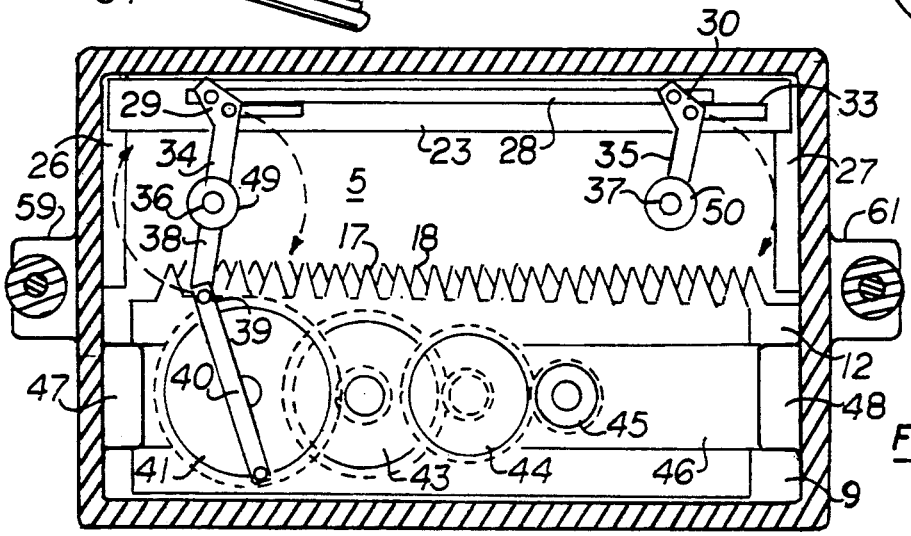
FIG. 7 is a cross-sectional view of the driving mechanism taken along line 7—7 of FIG. 1.
Figure 6:
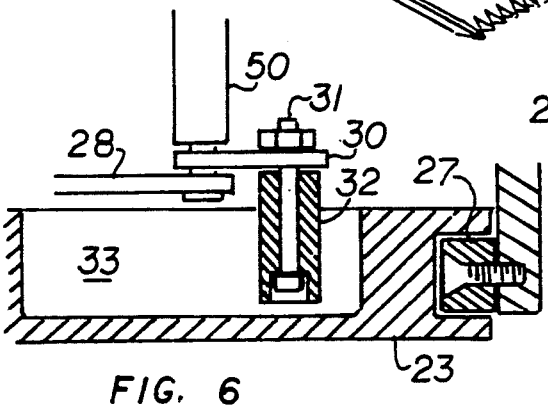
FIG. 6 is a partial cross-sectional view taken along line 6—6 of FIG. 3.

A hair-feeding bar 23 parallel to the blade rows of teeth 17, 18 has notches 24, 25 at opposite ends which are engaged over a pair of guiding rails 26, 27 bolted against the inner lateral edges of the rim 6. The rails 26, 27 act as bearings for the longitudinally translating movement of the bar across the flow chamber inlet. The bar 23 is driven by a mechanism more specifically illustrated in FIGS. 3, 4, and 6–8. This mechanism first comprises a parallogrammic linkage consisting of the bar 23, a linking rod 28 and two parallel members 29, 30 pivotally connected to the bar 23 and the linking rod 28. As shown in FIG. 6, each end of the member 29, 30 mounts a downward extending pin 31. A roller 32 mounted on the pin rides inside a longitudinal groove 33 cut into the top of the bar 23. The parallel members 29, 30 have an arm 34, 35 pivotally connected to a fix bearing 36, 37. One arm 34 extends beyond the fix bearing 36 to form a lever 38 as shown in FIG. 7, the end 39 of the lever 38 is pivotally connected to a pushrod 40, the opposite end of which is pivotally connected to a gear cam 41. The cam gear 41 is linked to the shaft 42 of the electrical motor 21 by a series of decoupling gears 43, 44 and 45. The gear ratio between the shaft of the electrical motor and the gear cam 41 is such that the bar 23 is translated about twice a second across the flow chamber opening. The gears 41, 43, 44 and 45 are mounted on a plate 46 which is supported by two projections 47, 48 in the lateral wall of the housing 4. The bearings 36, 37 are supported by two tubular projections 49, 50 extending from the roof of the housing.

A length of quadrangular conduit 51 illustrated in FIGS. 1 and 8 extends downward from the rim 6. The length of conduit has bellowed walls made from a spring armature 52 covered with a fabric 53. The bellowed conduit is captured between the rim 6 and a pair of parallel supporting bars 54, 55. These bars have threaded rods 56, 57 each passing through a pair of loop projections 58, 59, 60, 61 extending from the outer walls of the housing. Between each pair of loop projections is a thumb-wheel 62, 63 threaded upon one of the rods 56, 57. Each side of the bellowed conduit 51 can be raised or lowered by turning the corresponding thumb-wheel. Accordingly, with the bar 54, 55 resting against the scalp of a subject, the cutting blades are positioned at a constant distance corresponding to the desired length of the cut hair. It should be noted that an uneven adjustment of the bellowed conduit 51 may be desirable when hair must be tapered in the back of the neck and around the ear and temples of the subject.

Figure 9:
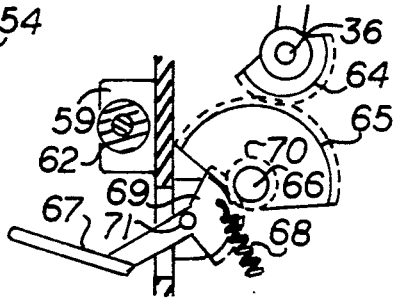
FIG. 9 is a partial cross-sectional view showing an alternate driving mechanism for the hair-feeding bar.
Figure 3:
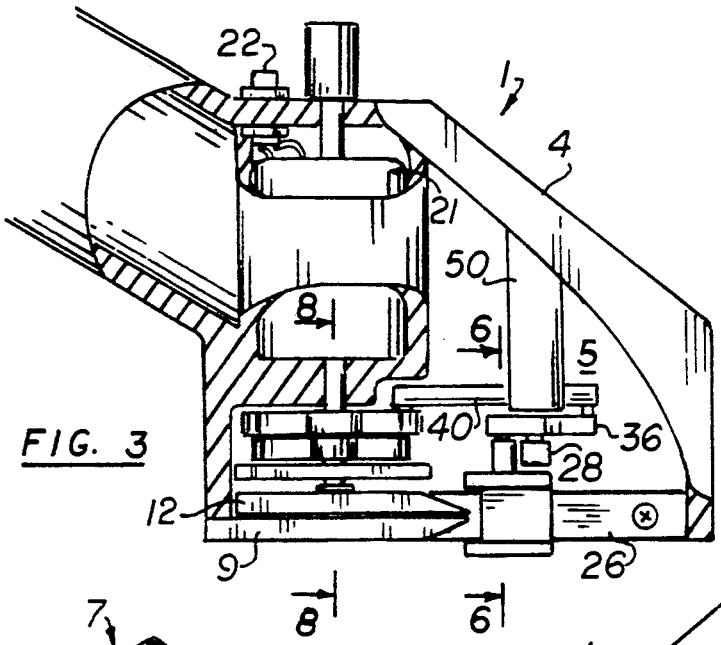
FIG. 3 is a lateral view of the clipper with a cut-out in the housing exposing the internal mechanism.

FIG. 9 illustrates an alternate, hand-driven mechanism for translating the hair-feeding bar 23. The lever 38 of the prior embodiment is replaced by a section of spur gear 64 pivotally mounted on bearing 36. This first sectional spur gear is driven by a second one 65 pivotally mounted on a second fix bearing 66 a thumb-active lever 67 biased by a spring 68 anchored to the housing 4 has a third sectional spur gear 69 acting against a smaller gear 70 concentrically attached to the second section spur gear 65. The lever 67 pivots around a fixed fulcrum point 71, and extends to the outside of the housing where it can be actioned by the thumb of the operator.

Figure 10:
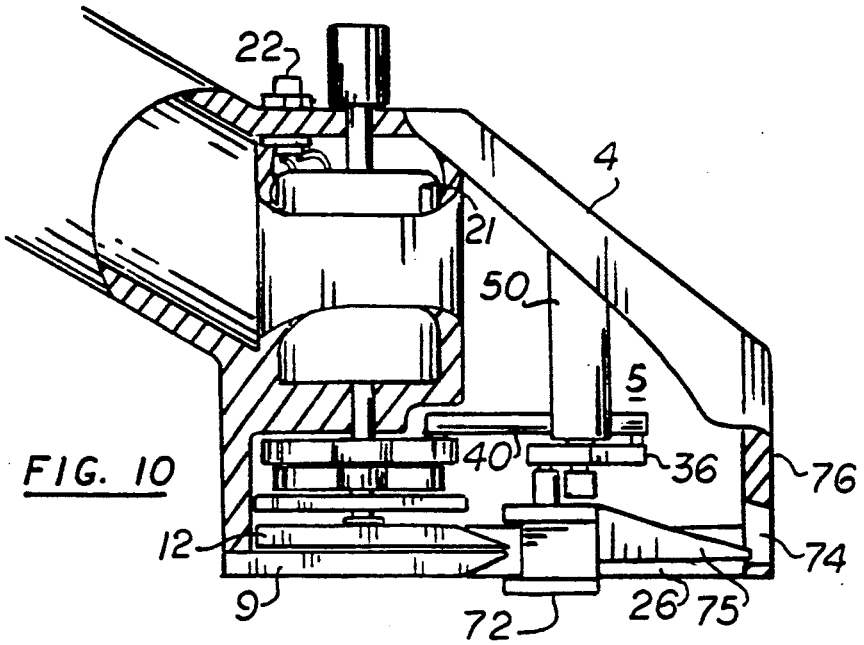
FIG. 10 is a lateral view of a clipper with a cut-out in the housing exposing an alternate embodiment of the hair-feeding bar.
Figure 11:
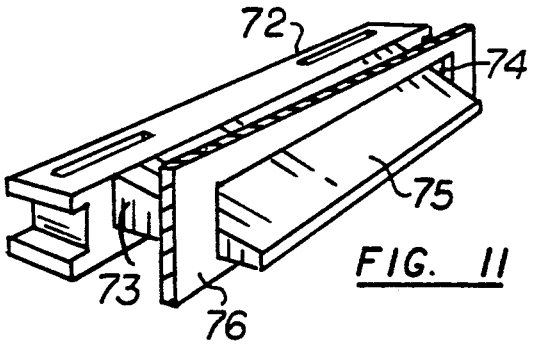
FIG. 11 is a perspective view of said alternate embodiment.

FIGS. 10 and 11 illustrates an alternate embodiment 72 of the hair-feeding bar 23. The bar 72 has a tapered or wedged tail or dorsal plate 73 which closes the space between the bar and the front of the housing 4. The dorsal plate penetrates a horizontal window 74 cut into the front wall 76 of the housing as the bar moves away from the blades 9, 12. The window is shaped and dimensioned to be completely closed by the thickest portion 75 of the wedged tail when the bar 72 reaches its most forward position away from the blades. At that time all the air drawn by the vacuum source passes between the blades and the bar 72 pulling the hair toward their cutting position. As the bar moves toward the blades, the wedged tail 73 prevents hair from being drawn between the bar 72 and the front wall 76 of the clipper. At the same time the withdrawing of the wedged tail from the window allows a progressive influx of air through the window which compensates for the progressive closure of the gap between the bar and the blades. Accordingly, a constant flow of air is drawn into the clipper. This avoids strain on the vacuum source motor and pulsations which could adversely affect the smooth and even drawing of the hair in front of the blades. The wedged tail also prevents hair from being drawn between the bar and the front part 76 of the housing.

While the preferred embodiments of the invention have been described, modifications can be made and other embodiments may be devised without departing from the spirit of the invention and the scope of the appended claims.

What is claimed is:

1. A precision hair clipper for cutting hair of a subject to a uniform length at a selectable spacing from the subject's scalp which comprises:

a housing defining a flow chamber having a substantially quandrangular inlet and an outlet connectable to a vacuum source;

a first blade fixedly mounted along a first side of said inlet, said first blade having a first row of shearing teeth along a transversal edge;

a second blade mounted against said first blade and having a second row of shearing teeth in line with said first row;

means for reciprocally and transversally sliding said second blade against said first blade;

a movable bar commensurate with said rows of teeth and spanning said inlet parallel to said rows; and means for reciprocally translating said bar across said inlet between said teeth and a side of said inlet opposite said first side, said means for reciprocally translating comprising:

a parallelogrammic linkage comprising said bar, a link rod parallel to said bar, and two parallel members pivotally connected at each end to said bar and link rod;

a lever extending from one of said parallel members, said lever being pivotally connected to a pushrod about a fulcrum point; and means for moving said lever around said fulcrum point.

2. The hair clipper of claim 1, wherein said means for moving comprise a cam linked to said means for reciprocally sliding said second blade.

3. The hair clipper of claim 1, wherein said means for reciprocally translating further comprise a thumb-operated lever extending outside the housing.

4. The hair clipper of claim 1, wherein said bar comprises a tapered dorsal plate shaped and dimensioned to penetrate, and to hermetically close an air inlet cut into a frontal section of the housing when said bar is in a furthermost position from said blades.

5. The hair clipper of claim 4, wherein said tapered dorsal plate is dimensioned to continuously obstruct a portion of said air inlet between said bar and the side of said inlet opposite said first side.

6. A precision hair clipper for cutting hair of a subject to a uniform length at a selectable spacing from the subject's scalp which comprises:

a housing defining a flow chamber having a substantially quandrangular inlet and an outlet connectable to a vacuum source;

a first blade fixedly mounted along a first side of said inlet, said first blade having a first row of shearing teeth along a transversal edge;

a second blade mounted against said first blade and having a second row of shearing teeth in line with said first row;

means for reciprocally and transversally sliding said second blade against said first blade;

a movable bar commensurate with said rows of teeth and spanning said inlet parallel to said rows;

means for reciprocally translating said bar across said inlet between said teeth and a side of said inlet opposite said first side;

wherein said inlet defines a planar rim;

said clipper further comprises means attachable to said rim for maintaining a uniform spacing between said inlet and the subject's scalp; and wherein said means for maintaining comprise a length of bellowed conduit having a cross-section commensurate with, and attached to, said rim; and means for adjustably extending the length of said conduit.

7. The hair clipper of claim 6, wherein said means for adjustably extending comprise a pair of threaded rods mounted against opposite external sides of the housing and being connected at distal ends to distal end areas of said conduit; and a pair of thumb-wheels engaging said rods.

* * * * *